US009598824B2

(12) United States Patent
Swanson

(10) Patent No.: US 9,598,824 B2
(45) **Date of Patent: *Mar. 21, 2017**

(54) APPARATUS AND METHOD FOR AN ASPHALTIC MATERIAL CONTROL SYSTEM

(71) Applicant: Astec, Inc., Chattanooga, TN (US)

(72) Inventor: Malcolm L. Swanson, Chickamauga, GA (US)

(73) Assignee: Astec, Inc., Chattanooga, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/145,164

(22) Filed: May 3, 2016

(65) Prior Publication Data

US 2016/0244920 A1 Aug. 25, 2016

Related U.S. Application Data

(63) Continuation-in-part of application No. 14/339,681, filed on Jul. 24, 2014, now Pat. No. 9,353,489.

(60) Provisional application No. 61/958,275, filed on Jul. 24, 2013.

(51) Int. Cl.
*E01C 19/10* (2006.01)

(52) U.S. Cl.
CPC ..... *E01C 19/1068* (2013.01); *E01C 19/1004* (2013.01); *E01C 19/1009* (2013.01); *E01C 19/1063* (2013.01); *E01C 19/1072* (2013.01); *E01C 19/1077* (2013.01)

(58) Field of Classification Search
CPC .. E01C 19/10; E01C 19/1004; E01C 19/1009; E01C 19/1013; E01C 19/1077; E01C 19/16
USPC ..... 404/72, 111, 84.05
See application file for complete search history.

(56) References Cited

U.S. PATENT DOCUMENTS 3,971,666 A * 7/1976 Mendenhall ..... E01C 19/1036 106/273.1
5,405,440 A * 4/1995 Green ..... C08L 95/005 106/276
7,566,162 B1 * 7/2009 Swanson ..... C08L 95/00 366/15
9,322,138 B2 * 4/2016 Villalobos Davila . C04B 18/167
9,353,489 B1 * 5/2016 Swanson ..... E01C 19/1004
9,394,652 B2 * 7/2016 Reinke ..... C04B 26/26
(Continued)

*Primary Examiner* — Gary Hartmann
(74) *Attorney, Agent, or Firm* — Chambliss, Bahner & Stophel, P.C.

(57) ABSTRACT

A system for controlling the production of an asphalt mix. The preferred system comprises an asphaltic material source, an asphaltic material sensor, a liquid asphalt cement source, a liquid asphalt cement meter, and a controller. The asphaltic material sensor communicates the amount of asphaltic material liquid asphalt cement and the amount of asphaltic material moisture contained in the amount of asphaltic material to the controller, the liquid asphalt cement meter communicates the amount of liquid asphalt cement provided by the liquid asphalt cement source to the controller, and the controller controls the amount of asphaltic material provided by the asphaltic material source and the amount of the liquid asphalt cement provided by the liquid asphalt cement source. A method comprising controlling the amount of asphaltic material and the amount of liquid asphalt cement provided to the asphalt mix substantially continuously and substantially in real time.

20 Claims, 2 Drawing Sheets

(56) References Cited

U.S. PATENT DOCUMENTS

| | | | | |
|---|---|---|---|---|
| 2003/0026653 | A1* | 2/2003 | Crupi | E01C 23/065<br>404/75 |
| 2008/0041276 | A1* | 2/2008 | Riebesehl | C10C 3/007<br>106/660 |
| 2011/0110177 | A1* | 5/2011 | Velsor | B01F 13/0013<br>366/22 |
| 2012/0167802 | A1* | 7/2012 | Huh | C04B 26/26<br>106/669 |
| 2012/0263007 | A1* | 10/2012 | Swanson | E01C 19/05<br>366/7 |
| 2015/0047220 | A1* | 2/2015 | Swanson | E01C 19/1063<br>34/493 |

* cited by examiner

APPARATUS AND METHOD FOR AN ASPHALTIC MATERIAL CONTROL SYSTEM

CROSS-REFERENCES TO RELATED APPLICATIONS/PATENTS

This continuation-in-part application relates back to and claims the benefit of priority from U.S. patent application Ser. No. 14/339,681 entitled "Apparatus and Method for Asphalt Control System" and filed on Jul. 24, 2014, which relates back to and claims the benefit of priority from U.S. Provisional Application for Patent Ser. No. 61/958,275 entitled "AC Trim System" and filed on Jul. 24, 2013.

FIELD OF THE INVENTION

This invention relates generally to control systems used in connection with the production of mixtures, and particularly to control systems used in connection with the production of asphalt mixtures.

BACKGROUND AND DESCRIPTION OF THE PRIOR ART

It is known to use control systems in connection with the production of asphalt. Conventional control systems used in connection with the production of asphalt, however, suffer from one or more limitations. For example, conventional control systems used in connection with the production of asphalt do not accurately and precisely control the amount of liquid asphalt cement contained in the asphalt mix. More particularly, conventional control systems used in connection with the production of asphalt do not collect data relating to the amount of recycled liquid asphalt cement contained in the amount of recycled asphalt pavement (RAP) substantially continuously and substantially in real time. Conventional control systems used in connection with the production of asphalt do not collect data relating to the amount of moisture contained in the amount of recycled asphalt pavement substantially continuously and substantially in real time. Conventional control systems used in connection with the production of asphalt do not collect data relating to the amount of moisture contained in the amount of aggregate material substantially continuously and substantially in real time. Conventional control systems used in connection with the production of asphalt do not collect data relating to the amount of liquid asphalt cement used in the asphalt mix substantially continuously and substantially in real time.

Consequently, conventional control systems used in connection with the production of asphalt result in material waste, excess cost, and less than optimal asphalt mixes.

It would be desirable, therefore, to provide an apparatus and method for a control system used in connection with the production of asphalt that would be adapted to accurately and precisely control the amount of liquid asphalt cement contained in the asphalt mix. It would be further desirable if such an apparatus and method for a control system used in connection with the production of asphalt could be provided that would be adapted to collect data relating to the amount of recycled liquid asphalt cement contained in the amount of recycled asphalt pavement substantially continuously and substantially in real time. It would be still further desirable if such an apparatus and method for a control system used in connection with the production of asphalt could be provided that would be adapted to collect data relating to the amount of moisture contained in the amount of recycled asphalt pavement substantially continuously and substantially in real time. It would also be desirable if such an apparatus and method for a control system used in connection with the production of asphalt could be provided that would be adapted to collect data relating to the amount of moisture contained in the amount of aggregate material substantially continuously and substantially in real time. It would be further desirable if such an apparatus and method for a control system used in connection with the production of asphalt could be provided that would be adapted to collect data relating to the amount of liquid asphalt cement used in the asphalt mix substantially continuously and substantially in real time.

Additionally, it would be desirable if such an apparatus and method for a control system used in connection with the production of asphalt could be provided that would be adapted to reduce or eliminate material waste, excess cost, and less than optimal asphalt mixes.

ADVANTAGES OF THE PREFERRED EMBODIMENTS OF THE INVENTION

It is an advantage of the preferred embodiments of invention to provide an apparatus and method for a control system used in connection with the production of asphalt that accurately and precisely controls the amount of liquid asphalt cement contained in the asphalt mix. It is another advantage of the preferred embodiments of invention to provide an apparatus and method for a control system used in connection with the production of asphalt that collects data relating to the amount of recycled liquid asphalt cement contained in the amount of recycled asphalt pavement (RAP) substantially continuously and substantially in real time. It is a further advantage of the preferred embodiments of invention to provide an apparatus and method for a control system used in connection with the production of asphalt that collects data relating to the amount of moisture contained in the amount of recycled asphalt pavement substantially continuously and substantially in real time. It is yet another advantage of the preferred embodiments of invention to provide an apparatus and method for a control system used in connection with the production of asphalt that collects data relating to the amount of moisture contained in the amount of aggregate material substantially continuously and substantially in real time. In addition, it is an advantage of the preferred embodiments of invention to provide an apparatus and method for a control system used in connection with the production of asphalt that collects data relating to the amount of liquid asphalt cement used in the asphalt mix substantially continuously and substantially in real time. In addition, the preferred embodiments of the invention provide an apparatus and method for a control system that is adapted to control the production of an asphalt mix comprising any type of asphaltic material substantially continuously and substantially in real time.

Additionally, it is an advantage of the preferred embodiments of invention to provide an apparatus and method for a control system used in connection with the production of asphalt that reduces or eliminates material waste, excess cost, and less than optimal asphalt mixes.

Additional advantages of the preferred embodiments of the invention will become apparent from an examination of the drawings and the ensuing description.

EXPLANATION OF TECHNICAL TERMS

As used herein, the term "asphaltic material" means any material containing asphalt, asphalt cement, or bitumen, whether natural, refined, or manufactured, including without limitation, recycled asphalt pavement (RAP), roofing shingles, flooring, and the like.

SUMMARY OF THE INVENTION

The apparatus of the invention comprises a system for controlling the production of an asphalt mix. The preferred system comprises an asphaltic material source that is adapted to provide an amount of asphaltic material to the asphalt mix and an asphaltic material sensor that is adapted to determine an amount of asphaltic material liquid asphalt cement contained in the amount of asphaltic material provided by the asphaltic material source and an amount of asphaltic material moisture contained in the amount of asphaltic material provided by the asphaltic material source. The preferred system also comprises a liquid asphalt cement source that is adapted to provide an amount of liquid asphalt cement to the asphalt mix and a liquid asphalt cement meter that is adapted to determine the amount of liquid asphalt cement provided by the liquid asphalt cement source. The preferred system further comprises a controller that is adapted to communicate with the asphaltic material source, the asphaltic material sensor, the liquid asphalt cement source, and the liquid asphalt cement meter. In the preferred system, the asphaltic material sensor communicates the amount of asphaltic material liquid asphalt cement contained in the amount of asphaltic material and the amount of asphaltic material moisture contained in the amount of asphaltic material to the controller, the liquid asphalt cement meter communicates the amount of liquid asphalt cement provided by the liquid asphalt cement source to the controller, and the controller controls the amount of asphaltic material provided by the asphaltic material source and the amount of the liquid asphalt cement provided by the liquid asphalt cement source.

The method of the invention comprises a method for controlling the production of an asphalt mix. The preferred method for controlling the production of an asphalt mix comprises providing a system for controlling the production of the asphalt mix as described above in this section. The preferred method further comprises controlling the amount of asphaltic material and the amount of liquid asphalt cement provided to the asphalt mix substantially continuously and substantially in real time.

BRIEF DESCRIPTION OF THE DRAWINGS

The presently preferred embodiments of the invention are illustrated in the accompanying drawing, in which like reference numerals represent like parts throughout, and in which.

DESCRIPTION OF THE PREFERRED EMBODIMENTS OF THE INVENTION

Figure 1:
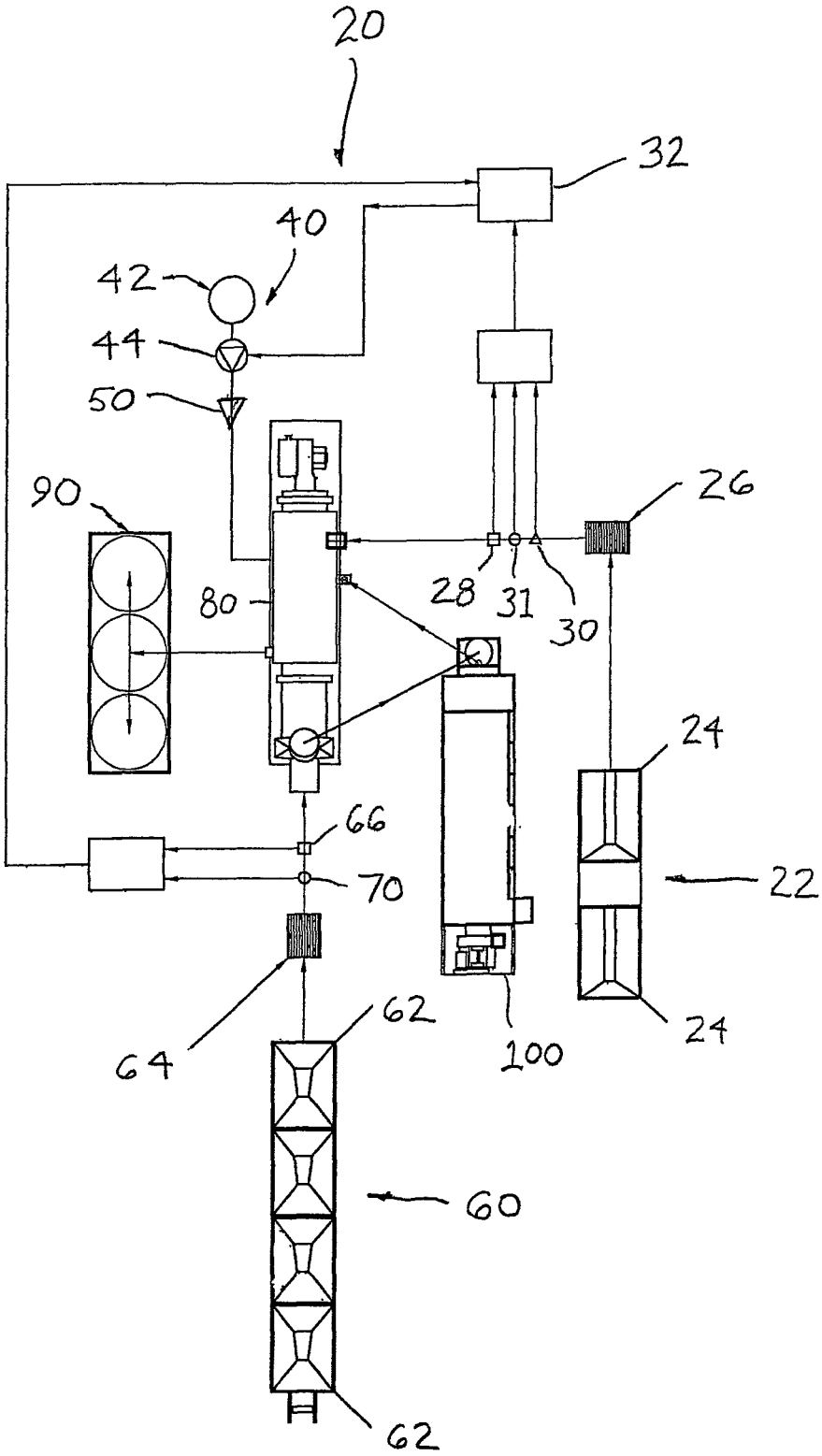
FIG. 1 is a schematic view of the preferred embodiment of the control system in accordance with the present invention.
Figure 2:
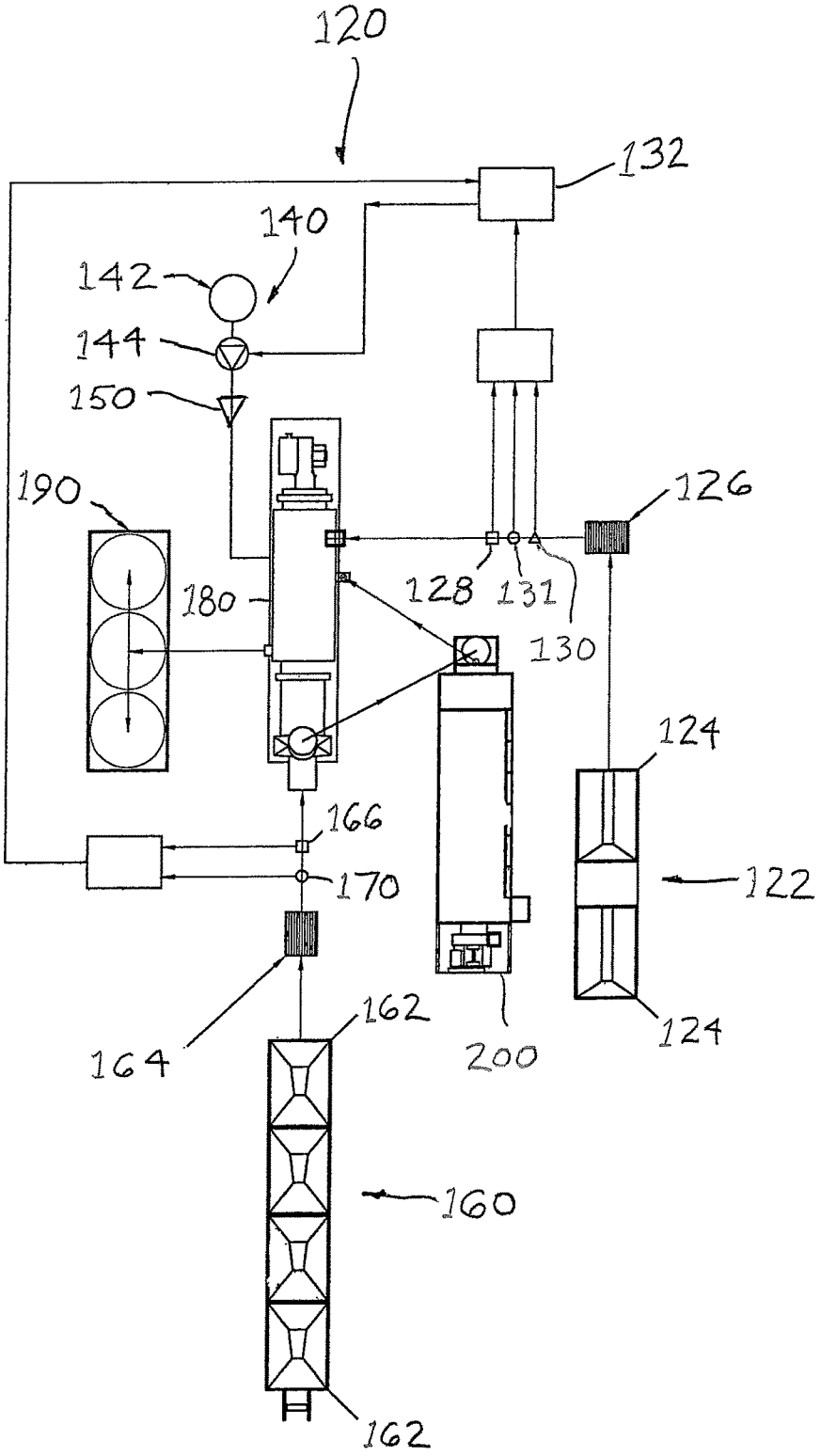
FIG. 2 is a schematic view of a first alternative embodiment of the control system in accordance with the present invention.

Referring now to the drawings, the preferred embodiment of the control system in accordance with the present invention is illustrated by FIGS. 1 and 2. As shown in FIGS. 1 and 2, the preferred control system is adapted to collect data substantially continuously and substantially in real time. More particularly, the preferred control system is adapted to collect data relating to the amounts of the following ingredients of an asphalt mix: (i) virgin aggregate material; (ii) moisture contained in the virgin aggregate material; (iii) asphaltic material and/or recycled asphalt pavement (RAP); (iv) moisture contained in the asphaltic material and/or recycled asphalt pavement; and (v) asphaltic material and/or recycled liquid asphalt cement contained in the asphaltic material and/or recycled asphalt pavement. Using this substantially continuously and substantially real time collected data, the preferred control system determines and controls the injection rate of virgin liquid asphalt into the asphalt mix substantially continuously and substantially in real time.

Referring now to FIG. 1, a schematic view of the preferred embodiment of the control system in accordance with the present invention is illustrated. As shown in FIG. 1, the preferred control system is designated generally by reference numeral 20. Preferred control system 20 comprises a system for controlling the production of an asphalt mix having recycled asphalt pavement source 22. Preferred recycled asphalt pavement source 22 is adapted to provide an amount of recycled asphalt pavement to the asphalt mix via a conveyor or any other suitable device, mechanism, assembly or combination thereof adapted to convey recycled asphalt pavement to an asphalt mix. Preferably, recycled asphalt pavement source 22 is adapted to provide recycled asphalt pavement to the asphalt mix at a variable rate of tons per hour; however, it is contemplated within the scope of the invention that the recycled asphalt pavement source is adapted to provide recycled asphalt pavement to the asphalt mix at any suitable rate. Preferred recycled asphalt pavement source 22 comprises a container such as RAP bins 24, RAP screen 26, and a scale such as RAP belt scale 28. Preferred RAP bins 24 are adapted to receive, store, and dispense recycled asphalt pavement. Preferred RAP screen 26 is adapted to screen recycled asphalt pavement. Preferred RAP belt scale 28 is adapted to weigh recycled asphalt pavement. While FIG. 1 illustrates the preferred configuration and arrangement of the recycled asphalt pavement source, it is contemplated within the scope of the invention that the recycled asphalt pavement source may be of any suitable configuration and arrangement. It is also contemplated within the scope of the invention that the recycled asphalt pavement source may comprise any suitable device, mechanism, assembly, or combination thereof adapted to provide recycled asphalt pavement to an asphalt mix.

Still referring to FIG. 1, preferred control system 20 also comprises recycled asphalt pavement sensors 30 and 31. Preferred recycled asphalt pavement sensors 30 and 31 are adapted to determine an amount of recycled liquid asphalt cement contained in the amount of recycled asphalt pavement and determine an amount of RAP moisture contained in the amount of recycled asphalt pavement, respectively, provided by recycled asphalt pavement source 22. Preferably, recycled asphalt pavement sensors 30 and 31 are adapted to determine the amount of recycled liquid asphalt cement contained in the recycled asphalt pavement and the amount of RAP moisture contained in the recycled asphalt pavement, respectively, at a variable rate of tons per hour or percentage by weight; however, it is contemplated within the scope of the invention that the recycled asphalt pavement sensors may determine the amount of recycled liquid asphalt cement contained in the recycled asphalt pavement and the amount of RAP moisture contained in the recycled asphalt pavement, respectively, at any suitable rate. Preferred recycled asphalt pavement sensors 30 and 31 are also adapted to communicate the amount of recycled liquid asphalt cement contained in the amount of recycled asphalt pavement and the amount of RAP moisture contained in the amount of recycled asphalt pavement, respectively, to a controller such as microprocessor 32. Preferably, recycled asphalt pavement sensor 30 communicates the amount of recycled liquid asphalt cement contained in the amount of recycled asphalt pavement to the controller substantially continuously and substantially in real time. In addition, recycled asphalt pavement sensor 31 communicates the amount of RAP moisture contained in the amount of recycled asphalt pavement to the controller substantially continuously and substantially in real time. Preferred recycled asphalt pavement sensors 30 and 31 comprise an infrared sensor, a microwave sensor, and/or a radioactive material-based sensor. It is contemplated within the scope of the invention, however, that the recycled asphalt pavement sensors may comprise any suitable device, mechanism, assembly, or combination thereof adapted to determine the amount of recycled liquid asphalt cement and/or RAP moisture contained in the recycled asphalt pavement. While FIG. 1 illustrates two separate recycled asphalt pavement sensors 30 and 31, it is contemplated within the scope of the invention that fewer or more than two sensors may be provided to determine the amount of recycled liquid asphalt cement and the amount of RAP moisture contained in the recycled asphalt pavement.

Still referring to FIG. 1, preferred control system 20 further comprises liquid asphalt cement source 40. Preferred liquid asphalt cement source 40 is adapted to provide an amount of liquid asphalt cement to the asphalt mix via a conduit or any other suitable device, mechanism, assembly, or combination thereof adapted to convey liquid asphalt cement to an asphalt mix. Preferred liquid asphalt cement source 40 comprises a container such as liquid asphalt cement tank 42 and a means for conveying liquid asphalt cement such as liquid asphalt cement pump 44. While FIG. 1 illustrates the preferred configuration and arrangement of the liquid asphalt cement source, it is contemplated within the scope of the invention that the liquid asphalt cement source may be of any suitable configuration and arrangement. It is also contemplated within the scope of the invention that the liquid asphalt cement source may comprise any suitable device, mechanism, assembly, or combination thereof adapted to provide liquid asphalt cement to an asphalt mix.

Still referring to FIG. 1, preferred control system 20 still further comprises liquid asphalt cement meter 50. Preferred liquid asphalt cement meter 50 is adapted to determine the amount of liquid asphalt cement provided by liquid asphalt cement source 40. Preferred liquid asphalt cement meter 50 is also adapted to communicate the amount of liquid asphalt cement provided by liquid asphalt cement source 40 to microprocessor 32. Preferably, liquid asphalt cement meter 50 communicates to microprocessor 32 the amount of liquid asphalt cement provided by liquid asphalt cement source 40 substantially continuously and substantially in real time. While FIG. 1 illustrates the preferred liquid asphalt cement meter, it is contemplated within the scope of the invention that any suitable device, mechanism, assembly, or combination thereof adapted to determine the amount of liquid asphalt cement provided by a liquid asphalt cement source to an asphalt mix may be used.

Still referring to FIG. 1, preferred control system 20 also comprises a controller such as microprocessor 32. Preferred microprocessor 32 is adapted to communicate with recycled asphalt pavement source 22, recycled asphalt pavement sensors 30 and 31, liquid asphalt cement source 40, and liquid asphalt cement meter 50. Preferred microprocessor 32 is also adapted to collect data from recycled asphalt pavement source 22, recycled asphalt pavement sensors 30 and 31, liquid asphalt cement source 40, and liquid asphalt cement meter 50. Preferably, microprocessor 32 is adapted to collect data from recycled asphalt pavement source 22, recycled asphalt pavement sensors 30 and 31, liquid asphalt cement source 40, and liquid asphalt cement meter 50 substantially continuously and substantially in real time. Preferred microprocessor 32 is further adapted to make calculations using the data collected from recycled asphalt pavement source 22, recycled asphalt pavement sensors 30 and 31, liquid asphalt cement source 40, and liquid asphalt cement meter 50. Preferably, microprocessor 32 is adapted to make calculations using the data collected from recycled asphalt pavement source 22, recycled asphalt pavement sensors 30 and 31, liquid asphalt cement source 40, and liquid asphalt cement meter 50 substantially continuously and substantially in real time. Preferred microprocessor 32 is still further adapted to control the amount of recycled asphalt pavement provided by recycled asphalt pavement source 22 to the asphalt mix and the amount of the liquid asphalt cement provided by liquid asphalt cement source 40 to the asphalt mix. Preferably, microprocessor 32 controls the amount of recycled asphalt pavement provided by recycled asphalt pavement source 22 and the amount of the liquid asphalt cement provided by liquid asphalt cement source 40 substantially continuously and substantially in real time.

Still referring to FIG. 1, preferred control system 20 further comprises aggregate material source 60. Preferred aggregate material source 60 is adapted to provide an amount of aggregate material to the asphalt mix via a conveyor or any other suitable device, mechanism, assembly, or combination thereof adapted to convey aggregate material to an asphalt mix. Preferred aggregate material source 60 comprises a container such as aggregate bins 62, aggregate screen 64, and a scale such as aggregate belt scale 66. Preferred aggregate bins 62 are adapted to receive, store, and dispense aggregate material. Preferred aggregate screen 64 is adapted to screen aggregate material. Preferred aggregate belt scale 66 is adapted to weigh aggregate material. Preferably, aggregate material source 60 is adapted to provide virgin aggregate material to the asphalt mix at a variable rate of tons per hour; however, it is contemplated within the scope of the invention that the aggregate material source may provide aggregate material to the asphalt mix at any suitable rate. While FIG. 1 illustrates the preferred configuration and arrangement of the aggregate material source, it is contemplated within the scope of the invention that the aggregate material source may be of any suitable configuration and arrangement. It is also contemplated within the scope of the invention that the aggregate material source may comprise any suitable device, mechanism, assembly, or combination thereof adapted to provide aggregate material to an asphalt mix.

Still referring to FIG. 1, preferred control system 20 still further comprises aggregate material sensor 70. Preferred aggregate material sensor 70 is adapted to determine an amount of aggregate moisture contained in the amount of aggregate material provided by aggregate material source 60. Preferably, aggregate material sensor 70 is adapted to determine the amount of aggregate moisture contained in the aggregate material at a variable rate of tons per hour or by a percentage of weight; however, it is contemplated within the scope of the invention that the aggregate material sensor may determine the amount of aggregate moisture contained in the aggregate material at any suitable rate. Preferred aggregate material sensor 70 is also adapted to communicate the amount of aggregate moisture contained in the amount of aggregate material to the controller. Preferably, aggregate material sensor 70 communicates the amount of aggregate moisture contained in the aggregate material to the controller substantially continuously and substantially in real time. Preferred aggregate material sensor 70 comprises an infrared sensor, a microwave sensor, and/or a radioactive material-based sensor, but it is contemplated within the scope of the invention that the aggregate material sensor may comprise any suitable device, mechanism, assembly, or combination thereof adapted to determine the amount of aggregate moisture in an amount of aggregate material.

Still referring to FIG. 1, preferred microprocessor 32 is adapted to communicate with aggregate material source 60 and aggregate material sensor 70. Preferred microprocessor 32 is also adapted to collect data from aggregate material source 60 and aggregate material sensor 70. Preferably, microprocessor 32 is adapted to collect data from aggregate material source 60 and aggregate material sensor 70 substantially continuously and substantially in real time. Preferred microprocessor 32 is further adapted to make calculations using the data collected from aggregate material source 60 and aggregate material sensor 70. Preferably, microprocessor 32 is adapted to make calculations using the data collected from aggregate material source 60 and aggregate material sensor 70 substantially continuously and substantially in real time. Preferred microprocessor 32 is still further adapted to control the amount of aggregate material provided by asphalt material source 60 to the asphalt mix. Preferably, microprocessor 32 controls the amount of aggregate material provided by aggregate material source 60 substantially continuously and substantially in real time.

Still referring to FIG. 1, preferred control system 20 may also comprise dryer/mixer 80, silos 90, and baghouse 100. It is also contemplated within the scope of the invention that other additives such as roofing shingles may be used to produce the asphalt mix. The preferred control system 20 is adapted to determine the amount of roofing shingles used in the asphalt mix, the amount of shingle moisture contained in the roofing shingles, and the amount of shingle liquid asphalt cement contained in the roofing shingles. It is further contemplated within the scope of the invention that mineral filler and lime may be used to produce the asphalt mix. Preferred control system 20 is adapted to determine the amount of mineral filler and the amount of lime used to produce the asphalt mix. Additives such as mineral filler and lime have no liquid asphalt cement content and negligible moisture content.

Referring now to FIG. 2, a schematic view of a first alternative embodiment of the control system in accordance with the present invention is illustrated. As shown in FIG. 2, the preferred control system is designated generally by reference numeral 120. Preferred control system 120 comprises a system for controlling the production of an asphalt mix having asphaltic material source 122. Preferred asphaltic material source 122 is adapted to provide an amount of asphaltic material to the asphalt mix via a conveyor or any other suitable device, mechanism, assembly or combination thereof adapted to convey asphaltic material to an asphalt mix. Preferably, asphaltic material source 122 is adapted to provide asphaltic material to the asphalt mix at a variable rate of tons per hour; however, it is contemplated within the scope of the invention that the asphaltic material source is adapted to provide asphaltic material to the asphalt mix at any suitable rate. Preferred asphaltic material source 122 comprises a container such as asphaltic material bins 124, asphaltic material screen 126, and a scale such as asphaltic material belt scale 128. Preferred asphaltic material bins 124 are adapted to receive, store, and dispense asphaltic material. Preferred asphaltic material screen 126 is adapted to screen asphaltic material. Preferred asphaltic material belt scale 128 is adapted to weigh asphaltic material. While FIG. 2 illustrates the preferred configuration and arrangement of the asphaltic material source, it is contemplated within the scope of the invention that the asphaltic material source may be of any suitable configuration and arrangement. It is also contemplated within the scope of the invention that the asphaltic material source may comprise any suitable device, mechanism, assembly, or combination thereof adapted to provide asphaltic material to an asphalt mix.

Still referring to FIG. 2, preferred control system 120 also comprises asphaltic material sensors 130 and 131. Preferred asphaltic material sensors 130 and 131 are adapted to determine an amount of asphaltic material liquid asphalt cement contained in the amount of asphaltic material and determine an amount of asphaltic material moisture contained in the amount of asphaltic material, respectively, provided by asphaltic material source 122. Preferably, asphaltic material sensors 130 and 131 are adapted to determine the amount of asphaltic material liquid asphalt cement contained in the asphaltic material and the amount of asphaltic material moisture contained in the asphaltic material, respectively, at a variable rate of tons per hour or percentage by weight; however, it is contemplated within the scope of the invention that the asphaltic material sensors may determine the amount of asphaltic material liquid asphalt cement contained in the asphaltic material and the amount of asphaltic material moisture contained in the asphaltic material, respectively, at any suitable rate. Preferred asphaltic material sensors 130 and 131 are also adapted to communicate the amount of asphaltic material liquid asphalt cement contained in the amount of asphaltic material and the amount of asphaltic material moisture contained in the amount of asphaltic material, respectively, to a controller such as microprocessor 132. Preferably, asphaltic material sensor 130 communicates the amount of asphaltic material liquid asphalt cement contained in the amount of asphaltic material to the controller substantially continuously and substantially in real time. In addition, asphaltic material sensor 131 communicates the amount of asphaltic material moisture contained in the amount of asphaltic material to the controller substantially continuously and substantially in real time. Preferred asphaltic material sensors 130 and 131 comprise an infrared sensor, a near-infrared sensor, an optical sensor, a microwave sensor, and/or a radioactive material-based sensor. It is contemplated within the scope of the invention, however, that the asphaltic material sensors may comprise any suitable device, mechanism, assembly, or combination thereof adapted to determine the amount of asphaltic material liquid asphalt cement and/or asphaltic material moisture contained in the asphaltic material. While FIG. 2 illustrates two separate asphaltic material sensors 130 and 131, it is contemplated within the scope of the invention that fewer or more than two sensors may be provided to determine the amount of asphaltic material liquid asphalt cement and the amount of asphaltic material moisture contained in the asphaltic material.

Still referring to FIG. 2, preferred control system 120 further comprises liquid asphalt cement source 140. Preferred liquid asphalt cement source 140 is adapted to provide an amount of liquid asphalt cement to the asphalt mix via a conduit or any other suitable device, mechanism, assembly, or combination thereof adapted to convey liquid asphalt cement to an asphalt mix. Preferred liquid asphalt cement source 140 comprises a container such as liquid asphalt cement tank 142 and a means for conveying liquid asphalt cement such as liquid asphalt cement pump 144. While FIG. 2 illustrates the preferred configuration and arrangement of the liquid asphalt cement source, it is contemplated within the scope of the invention that the liquid asphalt cement source may be of any suitable configuration and arrangement. It is also contemplated within the scope of the invention that the liquid asphalt cement source may comprise any suitable device, mechanism, assembly, or combination thereof adapted to provide liquid asphalt cement to an asphalt mix.

Still referring to FIG. 2, preferred control system 120 still further comprises liquid asphalt cement meter 150. Preferred liquid asphalt cement meter 150 is adapted to determine the amount of liquid asphalt cement provided by liquid asphalt cement source 140. Preferred liquid asphalt cement meter 150 is also adapted to communicate the amount of liquid asphalt cement provided by liquid asphalt cement source 140 to microprocessor 132. Preferably, liquid asphalt cement meter 150 communicates to microprocessor 132 the amount of liquid asphalt cement provided by liquid asphalt cement source 140 substantially continuously and substantially in real time. While FIG. 2 illustrates the preferred liquid asphalt cement meter, it is contemplated within the scope of the invention that any suitable device, mechanism, assembly, or combination thereof adapted to determine the amount of liquid asphalt cement provided by a liquid asphalt cement source to an asphalt mix may be used.

Still referring to FIG. 2, preferred control system 120 also comprises a controller such as microprocessor 132. Preferred microprocessor 132 is adapted to communicate with asphaltic material source 122, asphaltic material sensors 130 and 131, liquid asphalt cement source 140, and liquid asphalt cement meter 150. Preferred microprocessor 132 is also adapted to collect data from asphaltic material source 122, asphaltic material sensors 130 and 131, liquid asphalt cement source 140, and liquid asphalt cement meter 150. Preferably, microprocessor 132 is adapted to collect data from asphaltic material source 122, asphaltic material sensors 130 and 131, liquid asphalt cement source 140, and liquid asphalt cement meter 150 substantially continuously and substantially in real time. Preferred microprocessor 132 is further adapted to make calculations using the data collected from asphaltic material source 122, asphaltic material sensors 130 and 131, liquid asphalt cement source 140, and liquid asphalt cement meter 150. Preferably, microprocessor 132 is adapted to make calculations using the data collected from asphaltic material source 122, asphaltic material sensors 130 and 131, liquid asphalt cement source 140, and liquid asphalt cement meter 150 substantially continuously and substantially in real time. Preferred microprocessor 132 is still further adapted to control the amount of asphaltic material provided by asphaltic material source 122 to the asphalt mix and the amount of the liquid asphalt cement provided by liquid asphalt cement source 140 to the asphalt mix. Preferably, microprocessor 132 controls the amount of asphaltic material provided by asphaltic material source 122 and the amount of the liquid asphalt cement provided by liquid asphalt cement source 140 substantially continuously and substantially in real time.

Still referring to FIG. 2, preferred control system 120 further comprises aggregate material source 160. Preferred aggregate material source 160 is adapted to provide an amount of aggregate material to the asphalt mix via a conveyor or any other suitable device, mechanism, assembly, or combination thereof adapted to convey aggregate material to an asphalt mix. Preferred aggregate material source 160 comprises a container such as aggregate bins 162, aggregate screen 164, and a scale such as aggregate belt scale 166. Preferred aggregate bins 162 are adapted to receive, store, and dispense aggregate material. Preferred aggregate screen 164 is adapted to screen aggregate material. Preferred aggregate belt scale 166 is adapted to weigh aggregate material. Preferably, aggregate material source 160 is adapted to provide virgin aggregate material to the asphalt mix at a variable rate of tons per hour; however, it is contemplated within the scope of the invention that the aggregate material source may provide aggregate material to the asphalt mix at any suitable rate. While FIG. 2 illustrates the preferred configuration and arrangement of the aggregate material source, it is contemplated within the scope of the invention that the aggregate material source may be of any suitable configuration and arrangement. It is also contemplated within the scope of the invention that the aggregate material source may comprise any suitable device, mechanism, assembly, or combination thereof adapted to provide aggregate material to an asphalt mix.

Still referring to FIG. 2, preferred control system 120 still further comprises aggregate material sensor 170. Preferred aggregate material sensor 170 is adapted to determine an amount of aggregate moisture contained in the amount of aggregate material provided by aggregate material source 160. Preferably, aggregate material sensor 170 is adapted to determine the amount of aggregate moisture contained in the aggregate material at a variable rate of tons per hour or by a percentage of weight; however, it is contemplated within the scope of the invention that the aggregate material sensor may determine the amount of aggregate moisture contained in the aggregate material at any suitable rate. Preferred aggregate material sensor 170 is also adapted to communicate the amount of aggregate moisture contained in the amount of aggregate material to the controller. Preferably, aggregate material sensor 170 communicates the amount of aggregate moisture contained in the aggregate material to the controller substantially continuously and substantially in real time. Preferred aggregate material sensor 170 comprises an infrared sensor, a microwave sensor, and/or a radioactive material-based sensor, but it is contemplated within the scope of the invention that the aggregate material sensor may comprise any suitable device, mechanism, assembly, or combination thereof adapted to determine the amount of aggregate moisture in an amount of aggregate material.

Still referring to FIG. 2, preferred microprocessor 132 is adapted to communicate with aggregate material source 160 and aggregate material sensor 170. Preferred microprocessor 132 is also adapted to collect data from aggregate material source 160 and aggregate material sensor 170. Preferably, microprocessor 132 is adapted to collect data from aggregate material source 160 and aggregate material sensor 170 substantially continuously and substantially in real time. Preferred microprocessor 132 is further adapted to make calculations using the data collected from aggregate material source 160 and aggregate material sensor 170. Preferably, microprocessor 132 is adapted to make calculations using the data collected from aggregate material source 160 and aggregate material sensor 170 substantially continuously and substantially in real time. Preferred microprocessor 132 is still further adapted to control the amount of aggregate material provided by asphalt material source 160 to the asphalt mix.

Preferably, microprocessor 132 controls the amount of aggregate material provided by aggregate material source 160 substantially continuously and substantially in real time.

Still referring to FIG. 2, preferred control system 120 may also comprise dryer/mixer 180, silos 190, and baghouse 200. It is also contemplated within the scope of the invention that other additives such as mineral filler and lime may be used to produce the asphalt mix. Preferred control system 120 is adapted to determine the amount of mineral filler and the amount of lime used to produce the asphalt mix. Additives such as mineral filler and lime have no liquid asphalt cement content and negligible moisture content.

The invention also comprises a method for controlling the production of an asphalt mix. The preferred method comprises providing a system for controlling the production of the asphalt mix. The preferred control system comprises a recycled asphalt pavement source that is adapted to provide an amount of recycled asphalt pavement to the asphalt mix and a recycled asphalt pavement sensor that is adapted to determine an amount of recycled liquid asphalt cement contained in the amount of recycled asphalt pavement provided by the recycled asphalt pavement source and determine an amount of RAP moisture contained in the amount of recycled asphalt pavement provided by the recycled asphalt pavement source. The preferred control system further comprises a liquid asphalt cement source that is adapted to provide an amount of liquid asphalt cement and a liquid asphalt cement meter that is adapted to determine the amount of liquid asphalt cement provided by the liquid asphalt cement source. The preferred control system still further comprises a controller that is adapted to communicate with the recycled asphalt pavement source, the recycled asphalt pavement sensor, the liquid asphalt cement source, and the liquid asphalt cement meter. In addition, in the preferred control system, the recycled asphalt pavement sensor communicates the amount of recycled liquid asphalt cement contained in the amount of recycled asphalt pavement and communicates the amount of RAP moisture contained in the amount of recycled asphalt pavement to the controller, the liquid asphalt cement meter communicates the amount of liquid asphalt cement provided by the liquid asphalt cement source to the controller, and the controller controls the amount of recycled asphalt pavement provided by the recycled asphalt pavement source and the amount of the liquid asphalt cement provided by the liquid asphalt cement source. The preferred method of the invention further comprises controlling the amount of recycled asphalt pavement and the amount of liquid asphalt cement provided to the asphalt mix substantially continuously and substantially in real time.

In other preferred embodiments of the invention, the method also comprises controlling the amount of aggregate material provided to the asphalt mix substantially continuously and substantially in real time. In yet other preferred embodiments of the invention, the method also comprises determining the amount of RAP moisture contained in the recycled asphalt pavement and the amount of recycled liquid asphalt contained in the recycled asphalt pavement substantially continuously and substantially in real time. In still other preferred embodiments of the invention, the method also comprises determining the amount of aggregate moisture contained in the aggregate material substantially continuously and substantially in real time.

In still other preferred embodiments of the method of the invention, the method for controlling the production of an asphalt mix comprises providing a system for controlling the production of the asphalt mix as illustrated by FIG. 2 and described hereinabove. The preferred method of the invention further comprises controlling the amount of asphaltic material and the amount of liquid asphalt cement provided to the asphalt mix substantially continuously and substantially in real time.

In operation, several advantages of the preferred embodiments of the apparatus and method for a control system are achieved. For example, the preferred embodiments of the invention provide an apparatus and method for a control system used in connection with the production of an asphalt mix that accurately and precisely controls the amount of liquid asphalt cement, recycled asphalt pavement and/or asphaltic material, and aggregate material contained in the asphalt mix substantially continuously and substantially in real time. The preferred embodiments of invention further provide an apparatus and method for a control system used in connection with the production of an asphalt mix that collects data relating to the amount of recycled liquid asphalt contained in the amount of recycled asphalt pavement and/or the amount of liquid asphalt cement in the amount of asphaltic material substantially continuously and substantially in real time. The preferred embodiments of invention still further provide an apparatus and method for a control system used in connection with the production of an asphalt mix that collects data relating to the amount of RAP moisture contained in the amount of recycled asphalt pavement and/or the amount of asphaltic material moisture contained in the amount of asphaltic material substantially continuously and substantially in real time. The preferred embodiments of invention also provide an apparatus and method for a control system used in connection with the production of an asphalt mix that collects data relating to the amount of aggregate moisture contained in the amount of aggregate material substantially continuously and substantially in real time. The preferred embodiments of invention further provide an apparatus and method for a control system used in connection with the production of asphalt that collects data relating to the amount of liquid asphalt cement used in the asphalt mix substantially continuously and substantially in real time. In addition, the preferred embodiments of the invention provide an apparatus and method for a control system that is adapted to control the production of an asphalt mix comprising any type of asphaltic material substantially continuously and substantially in real time. Additionally, the preferred embodiments of invention provide an apparatus and method for a control system used in connection with the production of an asphalt mix that reduces or eliminates material waste, excess cost, and less than optimal asphalt mixes.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. A system for controlling the production of an asphalt mix, said system comprising:

a. an asphaltic material source, said asphaltic material source being adapted to provide an amount of asphaltic material to the asphalt mix;

b. an asphaltic material sensor, said asphaltic material sensor being adapted to determine an amount of asphaltic material liquid asphalt cement contained in the amount of asphaltic material provided by the asphaltic material source and an amount of asphaltic material moisture contained in the amount of asphaltic material provided by the asphaltic material source;

c. a liquid asphalt cement source, said liquid asphalt cement source being adapted to provide an amount of liquid asphalt cement to the asphalt mix;

d. a liquid asphalt cement meter, said liquid asphalt cement meter being adapted to determine the amount of liquid asphalt cement provided by the liquid asphalt cement source;

e. a controller, said controller being adapted to communicate with the asphaltic material source, the asphaltic material sensor, the liquid asphalt cement source, and the liquid asphalt cement meter;

wherein the asphaltic material sensor communicates the amount of asphaltic material liquid asphalt cement contained in the amount of asphaltic material and the amount of asphaltic material moisture contained in the amount of asphaltic material to the controller; and wherein the liquid asphalt cement meter communicates the amount of liquid asphalt cement provided by the liquid asphalt cement source to the controller; and wherein the controller controls the amount of asphaltic material provided by the asphaltic material source and the amount of the liquid asphalt cement provided by the liquid asphalt cement source.

2. The system of claim 1 wherein the asphaltic material source comprises an asphaltic material bin.

3. The system of claim 1 wherein the asphaltic material source comprises an asphaltic material screen.

4. The system of claim 1 wherein the asphaltic material source comprises an asphaltic material scale.

5. The system of claim 1 wherein the asphaltic material sensor comprises an infrared sensor.

6. The system of claim 1 wherein the asphaltic material sensor comprises a microwave sensor.

7. The system of claim 1 wherein the asphaltic material sensor comprises a radioactive material-based sensor.

8. The system of claim 1 wherein the liquid asphalt cement source comprises a tank.

9. The system of claim 1 wherein the liquid asphalt cement source comprises a pump.

10. The system of claim 1 wherein the controller comprises a microprocessor.

11. The system of claim 1 wherein the asphaltic material sensor communicates the amount of asphaltic material liquid asphalt cement contained in the amount of asphaltic material and the amount of asphaltic material moisture contained in the amount of asphaltic material to the controller substantially continuously and substantially in real time; and wherein the liquid asphalt cement meter communicates to the controller the amount of liquid asphalt cement provided by the liquid asphalt cement source substantially continuously and substantially in real time; and wherein the controller controls the amount of asphaltic material provided by the asphaltic material source and the amount of the liquid asphalt cement provided by the liquid asphalt cement source substantially continuously and substantially in real time.

12. The system of claim 1 further comprising:

e. an aggregate material source, said aggregate material source being adapted to provide an amount of aggregate material to the asphalt mix;

f. an aggregate material sensor, said aggregate material sensor being adapted to determine an amount of aggregate moisture contained in the amount of aggregate material provided by the aggregate material source;

wherein the aggregate material sensor communicates the amount of aggregate moisture contained in the amount of aggregate material to the controller; and wherein the controller controls the amount of the aggregate material provided by the aggregate material source.

13. The system of claim 12 wherein the aggregate material source comprises an aggregate bin.

14. The system of claim 12 wherein the aggregate material source comprises an aggregate screen.

15. The system of claim 12 wherein the aggregate material source comprises an aggregate scale.

16. The system of claim 12 wherein the aggregate material sensor comprises an infrared sensor.

17. The system of claim 1 wherein the aggregate material sensor comprises a microwave sensor.

18. The system of claim 1 wherein the aggregate material sensor comprises a radioactive material-based sensor.

19. The system of claim 1 wherein the aggregate material sensor communicates the amount of aggregate moisture contained in the amount of aggregate material to the controller substantially continuously and substantially in real time; and wherein the controller controls the amount of the aggregate material provided by the aggregate material source substantially continuously and substantially in real time.

20. A method for controlling the production of an asphalt mix, said method comprising:

a. providing a system for controlling the production of the asphalt mix, said system comprising:

an asphaltic material source, said asphaltic material source being adapted to provide an amount of asphaltic material to the asphalt mix;

(ii) an asphaltic material sensor, said asphaltic material sensor being adapted to determine an amount of asphaltic material liquid asphalt cement contained in the amount of asphaltic material provided by the asphaltic material source and an amount of asphaltic material moisture contained in the amount of asphaltic material provided by the asphaltic material source;

(iii) a liquid asphalt cement source, said liquid asphalt cement source being adapted to provide an amount of liquid asphalt cement to the asphalt mix;

(iv) a liquid asphalt cement meter, said liquid asphalt cement meter being adapted to determine the amount of liquid asphalt cement provided by the liquid asphalt cement source;

(v) a controller, said controller being adapted to communicate with the asphaltic material source, the asphaltic material sensor, the liquid asphalt cement source, and the liquid asphalt cement meter;

wherein the asphaltic material sensor communicates the amount of asphaltic material liquid asphalt cement contained in the amount of asphaltic material and the amount of asphaltic material moisture contained in the amount of asphaltic material to the controller; and wherein the liquid asphalt cement meter communicates the amount of liquid asphalt cement provided by the liquid asphalt cement source to the controller; and wherein the controller controls the amount of asphaltic material provided by the asphaltic material source and the amount of the liquid asphalt cement provided by the liquid asphalt cement source;

b. controlling the amount of asphaltic material and the amount of liquid asphalt cement provided to the asphalt mix substantially continuously and substantially in real time.

* * * * *